US011322291B2

(12) United States Patent
Cho et al.

(10) Patent No.: US 11,322,291 B2
(45) Date of Patent: May 3, 2022

(54) COIL COMPONENT AND METHOD OF MANUFACTURING THE SAME

(71) Applicant: SAMSUNG ELECTRO-MECHANICS CO., LTD., Suwon-Si (KR)

(72) Inventors: Seong Min Cho, Suwon-Si (KR); Chang Hyun Shin, Suwon-Si (KR); Sang Seob Kim, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 204 days.

(21) Appl. No.: 16/126,554

(22) Filed: Sep. 10, 2018

(65) Prior Publication Data

US 2019/0252109 A1 Aug. 15, 2019

(30) Foreign Application Priority Data

Feb. 9, 2018 (KR) ..... 10-2018-0016442

(51) Int. Cl.
*H01F 17/04* (2006.01)
*H01F 27/28* (2006.01)
(Continued)

(52) U.S. Cl.
CPC ..... *H01F 27/2804* (2013.01); *H01F 17/0013* (2013.01); *H01F 17/04* (2013.01);
(Continued)

(58) Field of Classification Search
CPC ..... H01F 17/0013; H01F 17/04; H01F 2017/0073; H01F 2017/048;
(Continued)

(56) References Cited

U.S. PATENT DOCUMENTS 6,246,541 B1 * 6/2001 Furuichi ..... G11B 5/3116 360/123.41
2013/0249662 A1 * 9/2013 Tonoyama ..... H01F 17/0013 336/200

(Continued)

FOREIGN PATENT DOCUMENTS

JP 08-181019 A 7/1996
JP 2009-117546 A 5/2009

(Continued)

OTHER PUBLICATIONS

Japanese Office Action dated Feb. 12, 2019 issued in Japanese Patent Application No. 2018-167318 (with English translation).

(Continued)

*Primary Examiner* — Mang Tin Bik Lian
(74) *Attorney, Agent, or Firm* — Morgan, Lewis & Bockius LLP

(57) ABSTRACT

A coil component includes a magnetic body and a coil portion embedded in the magnetic body. The coil portion includes an internal insulating layer, coil patterns disposed on opposite surfaces of the internal insulating layer, an insulating wall disposed between turns of a coil pattern, an external insulating layer disposed on the insulating wall and the coil pattern, and a connection portion including a first conductive layer and a second conductive layer having a melting point lower than a melting point of the first conductive layer, and penetrating through the internal insulating layer to connect the coil patterns disposed on the opposite surfaces of the internal insulating layer to each other.

19 Claims, 9 Drawing Sheets

(51) Int. Cl.

| | |
|---|---|
| ***H01F 17/00*** | (2006.01) |
| ***H01F 27/29*** | (2006.01) |
| ***H01F 41/04*** | (2006.01) |
| ***H01F 27/32*** | (2006.01) |

(52) U.S. Cl.
CPC ..... *H01F 27/292* (2013.01); *H01F 27/323* (2013.01); *H01F 27/324* (2013.01); *H01F 41/041* (2013.01); *H01F 41/046* (2013.01); *H01F 2017/002* (2013.01); *H01F 2017/0073* (2013.01); *H01F 2017/048* (2013.01); *H01F 2027/2809* (2013.01)

(58) Field of Classification Search
CPC ..... H01F 2017/002; H01F 27/2804; H01F 27/292; H01F 27/324; H01F 27/323; H01F 2027/2809; H01F 41/041; H01F 41/046
USPC ..... 336/200, 223, 233
See application file for complete search history.

(56) References Cited

U.S. PATENT DOCUMENTS

2015/0035634 A1* 2/2015 Nakamura ..... H01F 41/046 336/170
2015/0102889 A1* 4/2015 Choi ..... H01F 17/0013 336/200
2015/0380152 A1* 12/2015 Itoh ..... H01F 41/041 336/200
2016/0012956 A1* 1/2016 Yang ..... H01F 41/042 336/200
2016/0155556 A1* 6/2016 Ohkubo ..... H01F 27/292 336/83
2016/0293451 A1* 10/2016 Koelling ..... H01L 27/12
2016/0351316 A1* 12/2016 Ohkubo ..... H01F 27/325
2016/0351321 A1* 12/2016 Lyoo ..... H01F 41/041
2017/0032882 A1* 2/2017 Yang ..... H01F 19/04
2017/0178789 A1 6/2017 Kim et al.
2017/0301453 A1 10/2017 Jo et al.
2017/0345556 A1 11/2017 Kim et al.

FOREIGN PATENT DOCUMENTS

| | | | |
|---|---|---|---|
| JP | 2016-225611 | A | 12/2016 |
| JP | 2017-191923 | A | 10/2017 |
| KR | 10-1994-0016305 | A | 7/1994 |
| KR | 10-2017-0073167 | A | 6/2017 |
| KR | 10-2017-0090130 | A | 8/2017 |
| KR | 10-2017-0133140 | A | 12/2017 |

OTHER PUBLICATIONS

Office Action issued in corresponding Korean Application No. 10-2018-0016442, dated Mar. 20, 2019.

* cited by examiner

COIL COMPONENT AND METHOD OF MANUFACTURING THE SAME

CROSS-REFERENCE TO RELATED APPLICATION(S)

This application claims benefit of priority to Korean Patent Application No. 10-2018-0016442 filed on Feb. 9, 2018 in the Korean Intellectual Property Office, the disclosure of which is incorporated herein by reference in its entirety.

TECHNICAL FIELD

The present disclosure relates to a coil component and a method of manufacturing the same.

BACKGROUND

Along with the miniaturization and thinning of electronic devices such as digital televisions (TV), mobile phones, or notebook PCs, there has also been a need to miniaturize and thin coil components applied to such electronic devices and, to satisfy this requirement, research into various types of thin coil components, e.g., a winding type or thin-film type coil components, has been actively conducted.

In the case of a general thin-film type coil component, coil patterns are formed on opposite surfaces of a substrate and, in this regard, the substrate is generally formed of a raw material with a relatively high thickness, such as a copper clad laminate (CCL).

SUMMARY

An aspect of the present disclosure may provide a coil component reducing an overall thickness of a coil portion while a coil pattern is maintained in terms of a height thereof.

In addition, a coil component may be configured in such a manner that turns of a coil pattern are relatively uniformly formed.

According to an aspect of the present disclosure, a coil component may include a magnetic body and a coil portion embedded in the magnetic body. The coil portion may include an internal insulating layer, coil patterns disposed on opposite surfaces of the internal insulating layer, an insulating wall disposed between turns of a coil pattern, an external insulating layer disposed on the insulating wall and the coil pattern, and a connection portion including a first conductive layer and a second conductive layer having a melting point lower than a melting point of the first conductive layer, and penetrating through the internal insulating layer to connect the coil patterns disposed on the opposite surfaces of the internal insulating layer to each other According to another aspect of the present disclosure, a method of manufacturing a coil component may include forming a first coil substrate and a second coil substrate, and simultaneously stacking the first coil substrate and the second coil substrate. The forming of the first coil substrate and the second coil substrate may include forming an insulating wall on one surface of a support substrate, forming a coil pattern between adjacent patterns of the insulating wall, and removing the support substrate.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
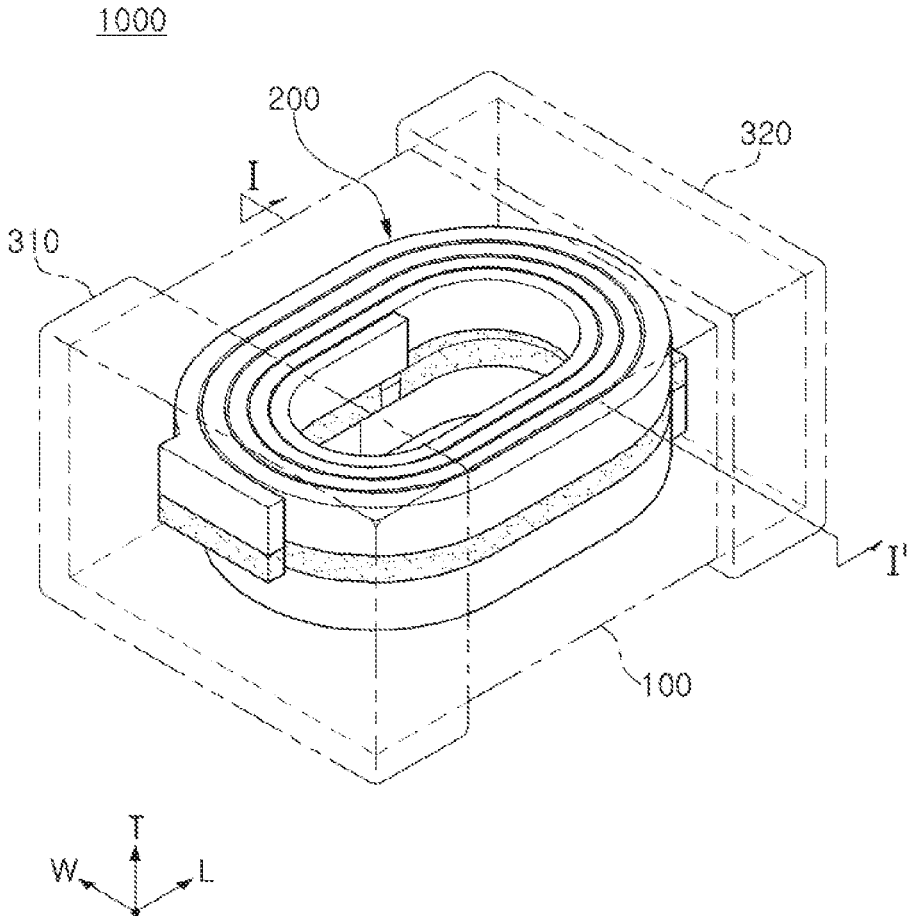
FIG. 1 is a schematic perspective view of a coil component according to an embodiment of the present disclosure.

Hereinafter, exemplary embodiments of the present disclosure will be described in detail with reference to the accompanying drawings.

In the drawings, an L direction may be defined as a first direction or a longitudinal direction, a W direction may be defined as a second direction or a width direction, and a T direction may be defined as a third direction or a thickness direction.

Hereinafter, a coil component and a method of manufacturing the same according to an embodiment of the present disclosure are described in detail with reference to the accompanying drawings. With regard to a description of the accompanying drawings, the same numerals in the drawings denote the same or like elements, and thus descriptions thereof will be omitted.

Coil Component

An electronic device uses various types of electronic components and, in this case, various types of coil components may be appropriately used between the electronic components to remove noise, and so on.

That is, the coil component in the electronic device may be a power inductor, a high frequency (HF) inductor, a general bead, a GHz bead, a common mode filter, or the like.

Hereinafter, a coil component according to an embodiment of the present disclosure is described and, for convenience of description, an inductor component is exemplified as a coil component but it is not intended to exclude a coil component except for the inductor component.

Figure 2:
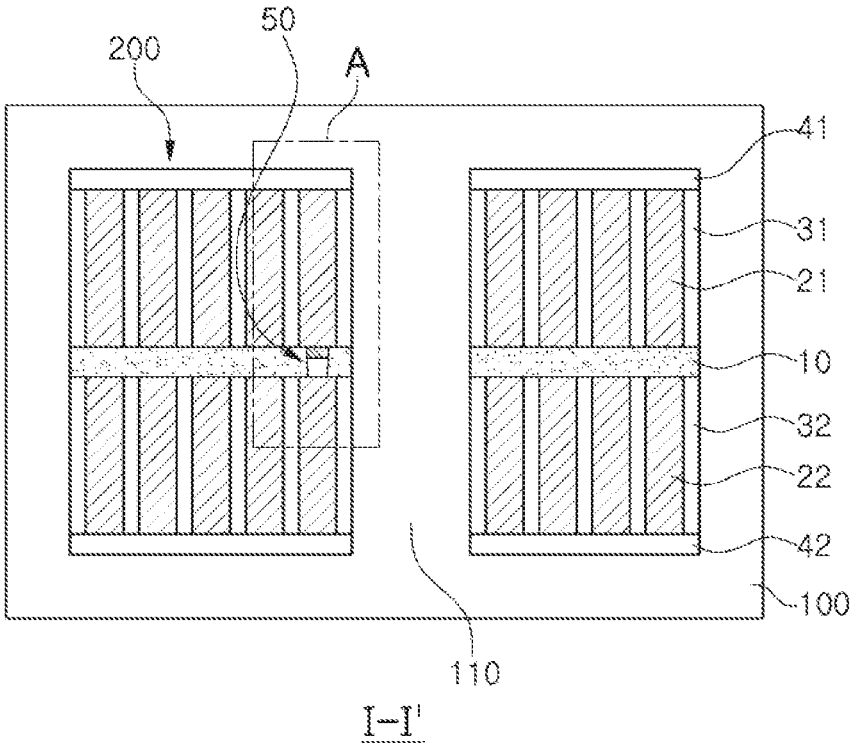
FIG. 2 is a cross-sectional view taken along line I-I' of FIG. 1.
Figure 3:
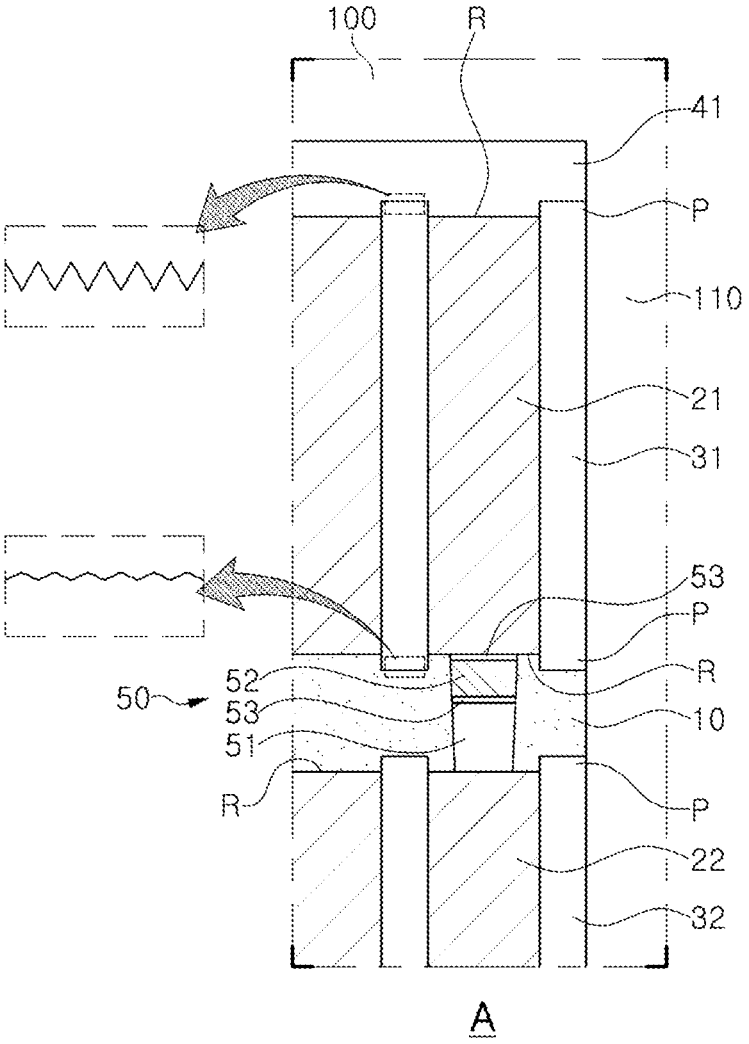
FIG. 3 is an enlarged view of portion A of FIG. 2.
Figure 4:
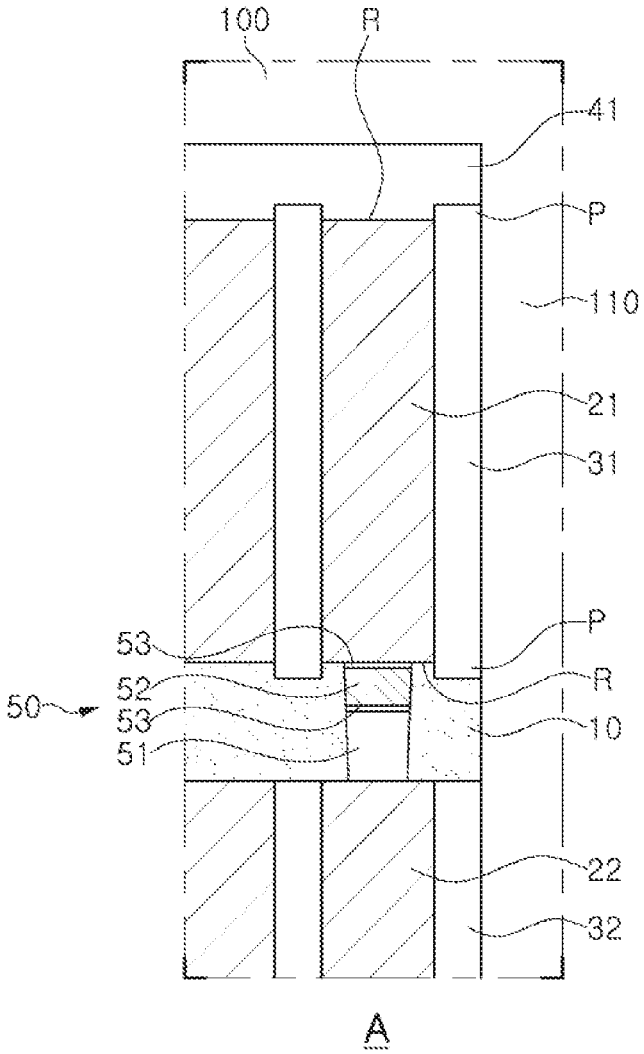
FIG. 4 is a view showing a modified example of a coil component according to an embodiment of the present disclosure and shows a portion corresponding to portion A of FIG. 2.

FIG. 1 is a schematic perspective view of a coil component according to an embodiment of the present disclosure. FIG. 2 is a cross-sectional view taken along line I-I' of FIG. 1. FIG. 3 is an enlarged view of portion A of FIG. 2. FIG. 4 is a view showing a modified example of a coil component according to an embodiment of the present disclosure and shows a portion corresponding to portion A of FIG. 2.

Referring to FIGS. 1 through 3, a coil component 1000 according to an embodiment of the present disclosure may include a magnetic body 100, a coil portion 200, and external electrodes 310 and 320.

The magnetic body 100 may configure an outer appearance of the coil component 1000 according to the present embodiment and may include the coil portion 200 embedded in the magnetic body 100.

A shape of the magnetic body 100 is not limited but, for example, may have an overall hexahedral shape.

When the magnetic body 100 has a hexahedral shape, the magnetic body 100 may include first and second surfaces facing each other in a first direction, third and fourth surfaces facing each other in a second direction, and fifth and sixth surfaces facing each other in a third direction.

The magnetic body 100 may be configured by dispersing a magnetic material in resin. The magnetic body 100 may be formed by stacking one or more magnetic sheets formed by dispersing a magnetic material in resin.

The magnetic material may be ferrite or a magnetic metallic powder particle.

The ferrite may be, for example, Mn—Zn-based ferrite, Ni—Zn-based ferrite, Ni—Zn—Cu-based ferrite, Mn—Mg-based ferrite, Ba-based ferrite, Li-based ferrite, or the like.

The magnetic metallic powder particle may include, for example, one or more selected from the group consisting of iron (Fe), silicon (Si), chromium (Cr), aluminum (Al), and nickel (Ni).

The magnetic metallic powder particle may be amorphous or crystalline. For example, the magnetic metallic powder particle may be Fe—Si—B—Cr-based amorphous metal but is not limited thereto.

The ferrite and the magnetic metallic powder particle may have an average diameter of about 0.1 μm to 30 μm but are not limited thereto.

The magnetic body 100 may include two or more magnetic materials dispersed in resin. For example, the magnetic body 100 may include two or more different magnetic metallic powder particles. Here, when stating that magnetic metallic powder particles are different, it means that the magnetic metallic powder particles are distinguished through any one of an average diameter, a material, and a shape.

The resin may be thermosetting resin such as epoxy resin or polyimide resin but is not limited thereto.

The magnetic body 100 may include a core 110 penetrating through the coil portion 200 that is described below. The core 110 may be formed by filling a through-hole TH (refer to FIG. 13) of the coil portion 200 with a magnetic sheet, but the present disclosure is not limited thereto.

When the coil component 1000 according to the present embodiment is mounted on an electronic device, the external electrodes 310 and 320 may electrically connect the coil component 1000 to the electronic device.

The external electrodes 310 and 320 may include a first external electrode 310 and a second external electrode 320 that are spaced apart on a surface of the magnetic body 100. The first external electrode 310 and a first coil pattern 21 of the coil portion 200 that is described below may be connected to each other and the second external electrode 320 and a second coil pattern 22 may be connected to each other.

The first external electrode 310 may be disposed on a first surface of the magnetic body 100 and may extend on a portion of each of third, fourth, fifth, and sixth surfaces of the magnetic body 100 but the present disclosure is not limited thereto. The second external electrode 320 may be disposed on a second surface of the magnetic body 100 and may extend on a portion of each of the third, fourth, fifth, and sixth surfaces of the magnetic body 100 but the present disclosure is not limited thereto.

The external electrodes 310 and 320 may each include a conductive resin layer and a conductor layer formed on conductive resin layer. The conductive resin layer may be formed via paste printing or the like and may include thermosetting resin and conductive metal of one or more selected from the group consisting of copper (Cu), nickel (Ni), and silver (Ag). The conductor layer may include one or more selected from the group consisting of nickel (Ni), copper (Cu), and tin (Sn) and may be formed by sequentially plating, for example, a nickel (Ni) layer and a tin (Sn) layer.

Alternatively, the external electrodes 310 and 320 may include a pre-plating layer (not shown) formed on the coil portion 200. The pre-plating layer (not shown) may include a first pre-plating layer (not shown) for connecting the first external electrode 310 and the first coil pattern 21 and a second pre-plating layer (not shown) for connecting the second external electrode 320 and the second coil pattern 22.

The pre-plating layer (not shown) may include a conductive material, for example, copper (Cu).

The coil portion 200 may be embedded in the magnetic body 100 and may include an internal insulating layer 10, coil patterns 21 and 22, insulating walls 31 and 32, external insulating layers 41 and 42, and a connection portion 50.

The internal insulating layer 10 may separate the first coil pattern 21 and the second coil pattern 22 from each other while supporting the first coil pattern 21 and the second coil pattern 22.

The internal insulating layer 10 may be formed of a thermosetting insulating resin such as an epoxy resin, a thermoplastic insulating resin such as polyimide, a photosensitive insulating resin, or insulating resin in which a stiffener, such as an inorganic filler, is impregnated. For example, the internal insulating layer 10 may be formed of a photo imagable dielectric (PID) film including a photosensitive insulating resin or a solder resist but is not limited thereto.

The inorganic filler may be at least one or more selected from the group consisting of silica ($SiO_2$), alumina ($Al_2O_3$), silicon carbide (SiC), barium sulfate ($BaSO_4$), talc, mud, mica powder particle, aluminium hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$).

To relatively thin the coil portion 200, the internal insulating layer 10 may not include a glass fiber.

When the internal insulating layer 10 includes a photosensitive insulating resin, a photolithography process may be possible. Thus, a fine hole may be more advantageously formed than in the case in which a hole is processed in a non-photosensitive insulating layer such as prepreg.

The coil patterns 21 and 22 may include the first coil pattern 21 disposed on one surface of the internal insulating layer 10 and the second coil pattern 22 disposed on the other surface of the internal insulating layer 10.

The coil patterns 21 and 22 may each have a planar coil shape and may each have the number of turns of a minimum two or more. The coil patterns 21 and 22 may each include a conductive material, for example, copper (Cu), aluminum (Al), silver (Ag), tin (Sn), gold (Au), nickel (Ni), palladium (Pd), or an alloy thereof and, in general, may include copper (Cu) but the present disclosure is not limited thereto.

When the coil patterns 21 and 22 are formed via plating, the coil patterns 21 and 22 may only include an electroplating layer. That is, according to the present disclosure, the coil patterns 21 and 22 may not include an electroless plating layer for forming the electroplating layer or a seed layer such as a seed metal thin film, which is described below.

The insulating walls 31 and 32 may include a first insulating wall 31 disposed between the turns of the first coil pattern 21 and a second insulating wall 32 disposed between the turns of the second coil pattern 22.

The insulating walls 31 and 32 may be formed of thermosetting insulating resin such as epoxy resin, thermoplastic insulating resin such as polyimide, photosensitive insulating resin, or an insulating resin in which a stiffener, such as an inorganic filler, is impregnated. For example, the insulating walls 31 and 32 may be formed of a photo imagable dielectric (PID) film including a photosensitive insulating resin or a solder resist but is not limited thereto.

The external insulating layers 41 and 42 may include a first external insulating layer 41 disposed on the first coil pattern 21 and the first insulating wall 31 and a second external insulating layer 42 disposed on the second coil pattern 22 and the second insulating wall 32.

The external insulating layers 41 and 42 may be formed of thermosetting insulating resin such as epoxy resin, thermoplastic insulating resin such as polyimide, photosensitive insulating resin, or insulating resin in which a stiffener, such as an inorganic filler, is impregnated. For example, the external insulating layers 41 and 42 may be formed of an Ajinomoto Build-up Film (ABF) but are not limited thereto.

The connection portion 50 may penetrate through the internal insulating layer 10 for connecting the first coil pattern 21 and the second coil pattern 22 to each other to form a coil rotating in one direction.

The connection portion 50 may include a first conductive layer 51 and a second conductive layer 52 having a lower melting point than that of the first conductive layer 51.

The first conductive layer 51 may be formed of a material having excellent electrical properties and a higher melting point than that of the second conductive layer 52, for example, copper (Cu), silver (Ag), palladium (Pd), aluminum (Al), nickel (Ni), titanium (Ti), gold (Au), platinum (Pt), or the like. For example, both of the second coil pattern 22 and the first conductive layer 51 may be formed of copper (Cu) and, in this case, may be formed of homogeneous materials to enhance binding force therebetween.

The second conductive layer 52 may have a lower melting point than that of the first conductive layer 51. The second conductive layer 52 may be formed of a solder material. Here, the 'solder' refers to a metallic material to be used in solder, may be an alloy including lead (Pb) but may not include lead (Pb). For example, the solder may be tin (Sn), silver (Ag), copper (Cu), or an alloy of metals selected thereamong. In detail, the solder used in an embodiment of the present disclosure may be an alloy including tin, silver, and copper with 90% or more of tin (Sn) with respect to the entire solder.

The second conductive layer 52 may be at least partially melted to alleviate pressure nonuniformity between coil substrates when coil substrates CS1 and CS2 (refer to FIG. 11) which are described below are simultaneously stacked.

The second conductive layer 52 may at least partially melted due to temperature and pressure during a simultaneous stacking process and, thus, may easily react with materials included in the first conductive layer 51 and/or the first coil pattern 21. Accordingly, the connection portion 50 may further include an inter-metal compound layer 53 formed between the first coil pattern 21 and the second conductive layer 52 and/or between the first conductive layer 51 and the second conductive layer 52. Binding force between the coil patterns 21 and 22 may be enhanced due to the inter-metal compound layer 53.

The insulating walls 31 and 32 may include a protrusion P protruding from at least one of opposite surfaces of the coil patterns 21 and 22 and is inserted into at least one of the internal insulating layer 10 and the external insulating layers 41 and 42.

Referring to FIG. 3, the first insulating wall 31 may include the protrusion P protruding from each of lower and upper surfaces of the first coil pattern 21. Accordingly, the protrusion P may be inserted into each of the internal insulating layer 10 and the first external insulating layer 41. The aforementioned protrusion P may also be formed on the second insulating wall 32. A recessed portion R may be formed on the coil patterns 21 and 22 complementarily with the protrusion P of the insulating walls 31 and 32.

The recessed portion R of the coil patterns 21 and 22 may be one of unique features based on a method of manufacturing a coil component according to an embodiment of the present disclosure. That is, the coil patterns 21 and 22 may be formed via electroplating by using a seed layer and, then, the seed layer accumulating on each of the coil substrates CS1 and CS2 may be removed (refer to FIGS. 9 and 10) because a portion of the coil patterns 21 and 22 is removed along with the seed layer.

During a simultaneous stacking process, portions of the internal insulating layer 10, the first external insulating layer 41, and the second external insulating layer 42 may be filled in the recessed portion R of the coil patterns 21 and 22 due to pressure and temperature.

Thus far, although the case in which the protrusion P and the recessed portion R are formed on all of upper and lower surfaces of the first insulating wall 31 and upper and lower surfaces of the second insulating wall 32 has been described, a position at which the protrusion P and the recessed portion R are formed may be changed in various ways by changing a manufacturing method.

For example, the protrusion P may only be formed on the upper surface of the first insulating wall 31 and the lower surface of the second insulating wall 32. Alternatively, the protrusion P may only be formed on the upper surface of the first insulating wall 31 and the upper and lower surfaces of the second insulating wall 32. Alternatively, as shown in FIG. 4, the protrusion P may only be formed on the upper and lower surfaces of the first insulating wall 31 and the lower surface of the second insulating wall 32 and may not be formed on the upper surface of the second insulating wall 32, which is described in detail with regard to a method of manufacturing a coil component according to an embodiment of the present disclosure.

Surface roughness of one surface of the insulating walls 31 and 32 may be different from surface roughness of the other surface of the insulating walls 31 and 32. For example, referring to FIG. 3, surface roughness of a lower surface of the second insulating wall 32 may be higher than surface roughness of an upper surface of the second insulating wall 32.

The second insulating wall 32 may be formed on one surface of a seed layer for forming the second coil pattern 22 and, in this case, a CZ treatment may be performed on one surface of the seed layer. Accordingly, when a PID film or the like is formed on one surface of the seed layer to form the second insulating wall 32, surface roughness of one surface of the seed layer may be transferred to a lower surface of a PID film or the like. Surface roughness of the lower surface of the second insulating wall 32 may be higher than surface roughness of the upper surface of the second insulating wall 32. The above description may also be applied to the first insulating wall 31.

The internal insulating layer 10 applied to the coil component 1000 according to the present embodiment may not include a glass fiber. That is, the internal insulating layer 10 may be thinned using a coreless scheme of a printed circuit board (PCB) without use of a core substrate used in a general coil component.

Accordingly, the coil component 1000 according to the present embodiment may embody the relatively thinned coil portion 200. Accordingly, compared with the coil component with the same size, a volume of the magnetic body 100 according to the present embodiment may be increased to increase inductive capacity (Ls).

Method of Manufacturing Coil Component

FIGS. 5 through 14 are diagrams sequentially showing processes of manufacturing a coil component according to an embodiment of the present disclosure.

Referring to FIGS. 5 through 14, a method of manufacturing a coil component according to an embodiment of the present disclosure may include forming a first coil substrate and a second coil substrate, simultaneously stacking the first coil substrate and the second coil substrate and, then, performing post-processing.

Hereinafter, an operation of forming a coil substrate and an operation of attaching coil substrates are separately described.

(Operation of Forming Coil Substrate)

Hereinafter, a method of manufacturing a second coil substrate is exemplified and a description of a method of manufacturing a first coil substrate is omitted herein. The method of manufacturing the second coil substrate may be applied to the method of manufacturing the first coil substrate in similar ways.

Although FIGS. 6 through 9 show the case in which the following process is performed on only one surface of a support substrate C, this is only for convenience of description and illustration. Accordingly, the same process may also be performed on the other surface of the support substrate C. Alternatively, a process for forming the second coil substrate may be performed on one surface of the support substrate C and a process for forming the first coil substrate may be performed on the other surface of the support substrate C.

Figure 5:
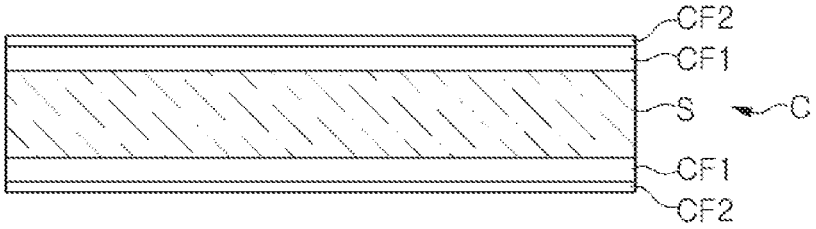
FIGS. 5 through 14 are diagrams sequentially showing processes of manufacturing a coil component according to an embodiment of the present disclosure.

First, referring to FIG. 5, a support substrate C may be prepared.

The support substrate C may be a general subsidiary material used to perform a coreless scheme. That is, the support substrate C may include a support core S, carrier metal films CF1 formed on opposite surfaces of the support core S, and thin metal films CF2 formed on the carrier metal films CF1.

The support core S may be formed of prepreg (PPG) but is not limited thereto. The carrier metal films CF1 and the thin metal films CF2 may each be formed of copper (Cu) but are not limited thereto.

The support substrate C may further include a release layer (not shown) formed between the carrier metal film CF1 and the thin metal film CF2 but is not limited thereto.

Figure 6:
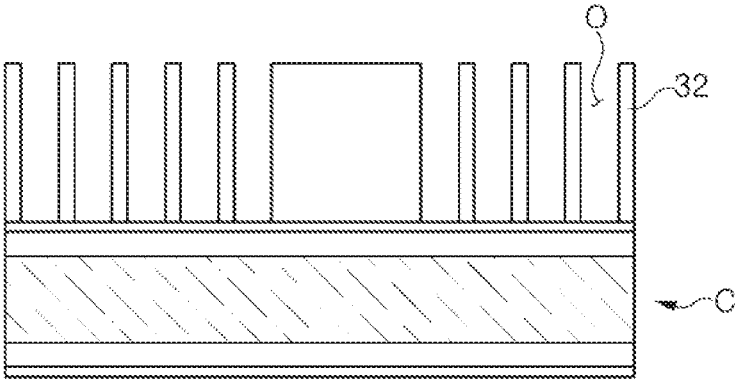

Then, referring to FIG. 6, a second insulating wall 32 may be formed on one surface of the support substrate C.

The second insulating wall 32 may be formed by forming an insulating film for forming the second insulating wall 32 on one surface of the support substrate C and, then, forming an opening O in the insulating film. The opening O may be formed to correspond to a shape and position of the second coil pattern 22.

When the insulating film for forming the second insulating wall includes photosensitive insulating resin, the opening O may be formed by a photolithography process.

When the insulating film for forming the second insulating wall includes non-photosensitive insulating resin, the opening O may be formed by a laser drilling. The opening O may be formed by stacking photosensitive materials such as a dry film on an upper surface of the insulating film for forming the second insulating wall, performing a photolithography process to form a resist opening at a position corresponding to the opening of the insulating film for forming the second insulating wall in the photosensitive materials, and selectively removing the insulating film for forming the second insulating wall exposed through the resist opening.

The present operation may further include forming a plating layer on one surface of the support substrate C and surface-processing one surface of the plating layer. In this case, the second insulating wall 32 may be formed on one surface of the plating layer. Accordingly, surface roughness of one surface-processed surface of the plating layer may be transferred to the lower surface of the insulating film for forming the second insulating wall. Surface roughness of the lower surface of the second insulating wall 32 may be different from the surface roughness of the upper surface of the second insulating wall 32.

Figure 7:
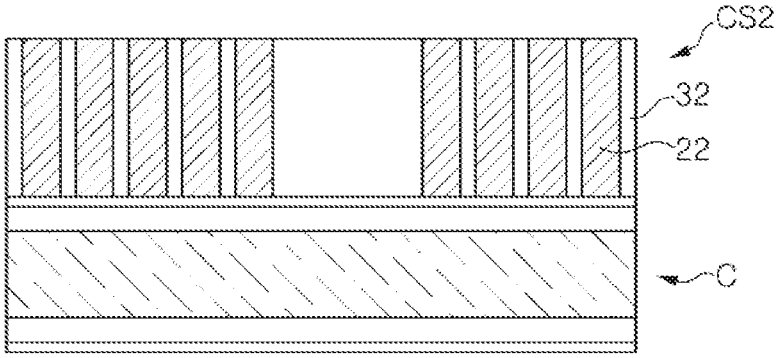

Then, referring to FIG. 7, a second coil pattern 22 may be formed in the opening of the second insulating wall 32.

The second coil pattern 22 may be formed in the opening O of the second insulating wall 32. The second coil pattern 22 may be formed through an electroplating process using the plating layer formed on the thin metal film CF2 or the thin metal film CF2 of the support substrate C, as a seed layer.

The present operation may further include performing excessive plating to cover the second insulating wall 32 and grinding the excessively plated electroplating layer to expose the upper surface of the second insulating wall 32.

Accordingly, a second coil substrate CS2 including the second coil pattern 22 and the second insulating wall 32 may be formed on one surface of the support substrate C. Hereinafter, for convenience of description, the case in which the second coil substrate CS2 includes the internal insulating layer 10 and the connection portion 50 is described.

Figure 8:
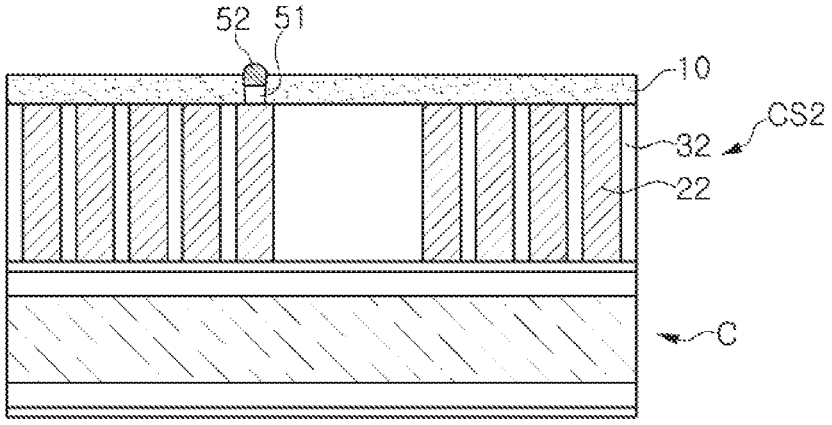

Then, referring to FIG. 8, an internal insulating layer may 10 be formed on a second coil substrate CS2 and a connection portion 50 penetrating through the internal insulating layer 10 may be formed.

The internal insulating layer 10 may be formed by stacking an insulating film for forming an internal insulating layer on an upper surface of the second coil substrate CS2 or coating the insulating material for forming the internal insulating layer in a liquid state on the upper surface of the second coil substrate CS2.

The insulating film for forming the internal insulating layer may be a PID film or a solder resist film including a photosensitive insulating resin but is not limited thereto.

The internal insulating layer 10 may be completely cured (C-stage) during a simultaneous stacking process that is described below. Accordingly, the internal insulating layer 10 may be maintained to be semi-cured (B-stage) prior to the simultaneous stacking process.

The connection portion 50 may penetrate through the internal insulating layer 10. When the internal insulating layer 10 includes photosensitive resin, the connection portion 50 may be formed by forming an opening in the internal insulating layer 10 using a photolithography process and forming the first conductive layer 51 and the second conductive layer 52 in the opening.

An electroless plating layer for forming the first conductive layer 51 may be formed on an internal wall of the opening but is not limited thereto. That is, the opening may expose the second coil pattern 22 therethrough and, thus, the first conductive layer 51 may be formed via plating in a bottom-up manner.

The second conductive layer 52 may be formed of metal having a lower melting point than that of the first conductive layer 51, for example, a solder. The second conductive layer 52 may be formed in the opening by plating the solder in the opening or filing the solder paste in the opening and, then, drying the solder paste.

The solder or the solder paste may include tin, silver, copper, or an alloy of metals selected thereamong, as a main component. In addition, the solder paste used in the present disclosure may not include flux.

A solder paste may be classified as a sintered-solder paste that is hardened at a relatively high temperature (e.g., 800° C.) or a hardened-solder paste that is hardened at a relatively low temperature (e.g., 200° C.). The solder paste used in the present embodiment may be a hardened-solder paste that is hardened at a relatively low temperature to prevent the internal insulating layer 10 from being completely hardened during formation of the second conductive layer 52.

The solder paste may have relatively high viscosity and a shape thereof may be maintained when inserted into an opening. The solder paste may have metallic particles and a surface of the second conductive layer 52 inserted into the opening may be uneven.

Figure 9:
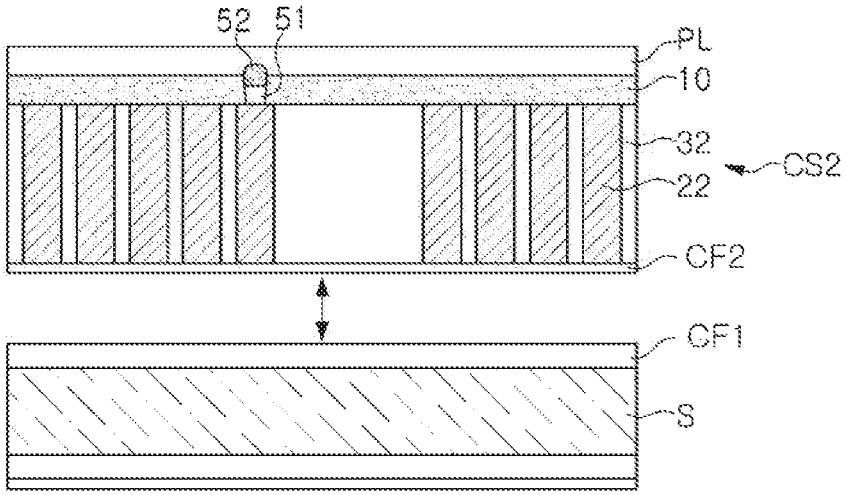

Then, referring to FIG. 9, a protective layer PL may be formed on one surface of the second coil substrate CS2 and, then, the support substrate C may be separated.

The protective layer PL may be a subsidiary material including thermoplastic resin. The protective layer PL may protect the second coil substrate CS2 up to a simultaneous stacking process. The protective layer PL may include a release layer and may be disposed to attach the release layer to one surface of the second coil substrate CS2.

The support substrate C may be removed from the second coil substrate CS2 when an interface between the carrier metal film CF1 and the thin metal film CF2 is separated. That is, even if the support substrate C is removed from the second coil substrate CS2, the thin metal film CF2 of the support substrate C may remain on the other surface of the second coil substrate CS2.

Figure 10:
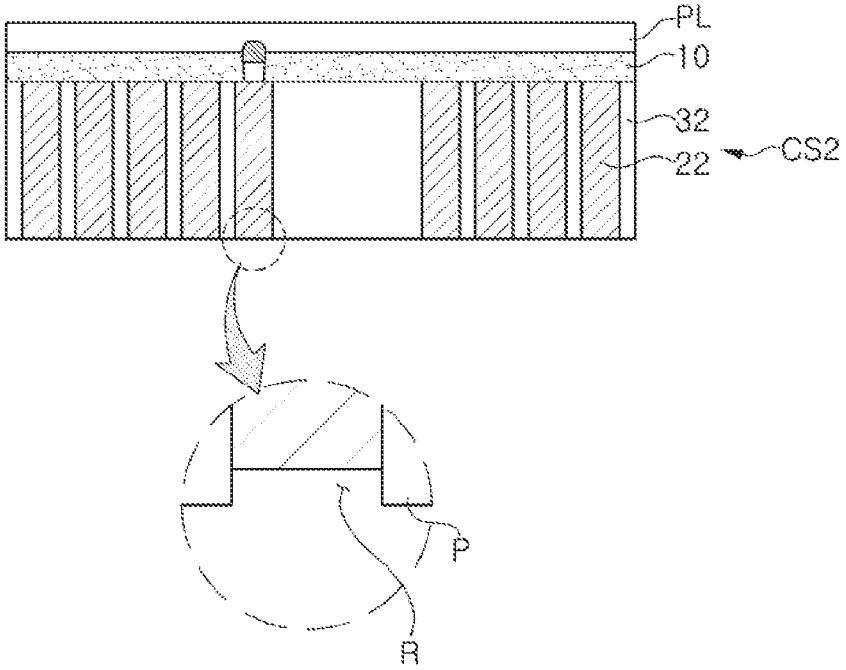

Then, referring to FIG. 10, the thin metal film CF2 that remains on the other surface of the second coil substrate may be removed.

The thin metal film CF2 may be removed via flash etching, half etching, or the like. As described above, when a plating layer is formed on one surface of the thin metal film CF2, a portion of the plating layer may be removed along with the thin metal film CF2 in the present operation.

When both the thin metal film CF2 and the second coil pattern 22 include copper (Cu), a portion of the second coil pattern 22 may be removed along with the thin metal film CF2. Accordingly, the recessed portion R may be formed in the second coil pattern 22 and the protrusion P may be formed in the second insulating wall 32 complementarily with the recessed portion R.

According to the present embodiment, the internal insulating layer 10 and the protective layer PL are formed on the second coil pattern 22 and an upper surface side of the second insulating wall 32 and, thus, the recessed portion R and the protrusion P may only be formed on a lower surface of the second coil pattern 22 and a lower surface of the second insulating wall 32.

The recessed portion R and the protrusion P may be formed at arbitrary positions by arbitrarily changing the aforementioned manufacturing order.

For example, when the second coil substrate CS2 and the support substrate C are separated in a state in which the protective layer PL is not formed on the second coil substrate CS2, the recessed portion R may also be formed on both the upper and lower surfaces of the second coil pattern 22 during removal of the thin metal film CF2 that remains on the lower surface of the second coil substrate CS2.

(Operation of Simultaneous Stacking)

Figure 11:
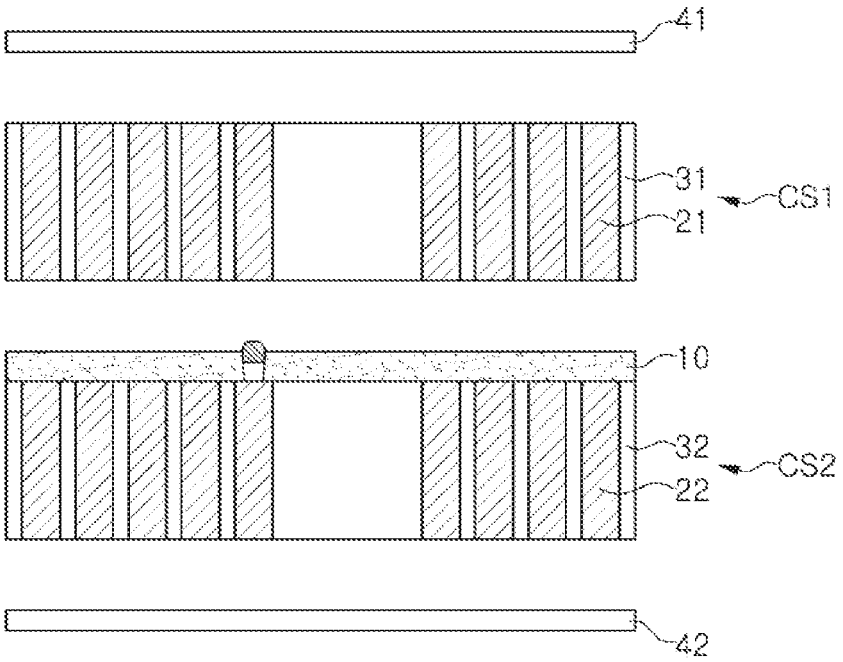

Referring to FIG. 11, protective layers that are attached to a first coil substrate CS1 and a second coil substrate CS2, respectively, may be removed.

A first coil substrate CS1, a second coil substrate CS2, a first external insulating layer 41, and a second external insulating layer 42 may be aligned.

Although not shown, a reference hole may be processed in each of the first coil substrate CS1, the second coil substrate CS2, the first external insulating layer 41, and the second external insulating layer 42, and the first coil substrate CS1, the second coil substrate CS2, the first external insulating layer 41, and the second external insulating layer 42 may be aligned based on the reference hole.

Figure 12:
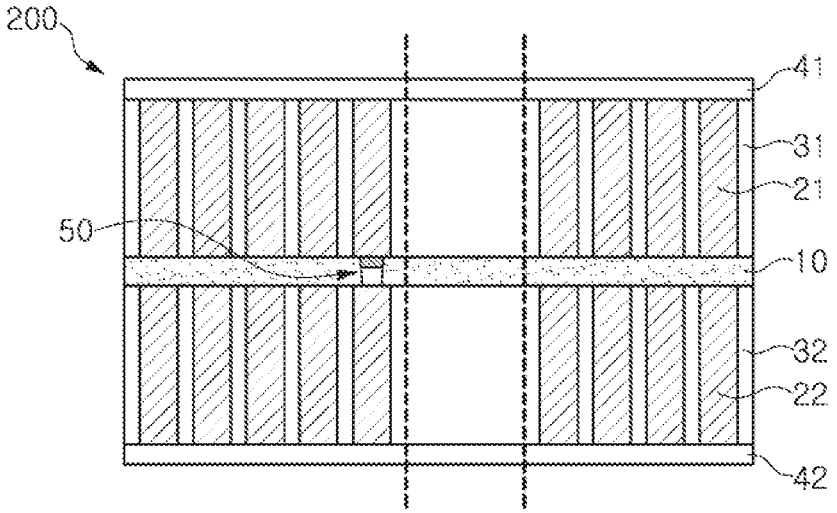

Then, referring to FIG. 12, the first coil substrate, the second coil substrate, the first external insulating layer, and the second external insulating layer may be simultaneously pressurized and heated.

In the present operation, temperature may be set to 180 to 200° C. and press pressure may be set to 30 to 50 kg/cm$^2$ but the present disclosure is not limited thereto. That is, temperature and pressure in the simultaneous stacking process may be set in different ways by components of the internal insulating layer 10 or the second conductive layer 52. In particular, temperature in the simultaneous stacking process may be equal to or greater than a melting point of the second conductive layer 52.

A portion of the second conductive layer 52 may be melted at temperature and pressure in the simultaneous stacking process. An upper portion of the second conductive layer 52 may be spread in all directions by a predetermined distance due to pressure in the simultaneous stacking process. In this case, since the second conductive layer 52 is spread after the simultaneous stacking process, an upper cross section of the connection portion 50 may be greater than a lower cross section of the connection portion 50. That is, the second conductive layer 52 may be spread into the internal insulating layer 10 in a semi-hardened state (B-stage) due to pressure in the simultaneous stacking process. Thus, a width of the second conductive layer 52 may be greater than a width of the first conductive layer 51.

Since the second conductive layer 52 is melted in the simultaneous stacking process, the inter-metal compound layer 53 may be formed between the second conductive layer 52 and the first conductive layer 51 and/or between the second conductive layer 52 and the first coil pattern 21.

In addition, the external insulating layers 41 and 42 and the internal insulating layer 10 in a semi-hardened state may be completely hardened after the simultaneous stacking process.

(Post-processing Operation)

Figure 13:
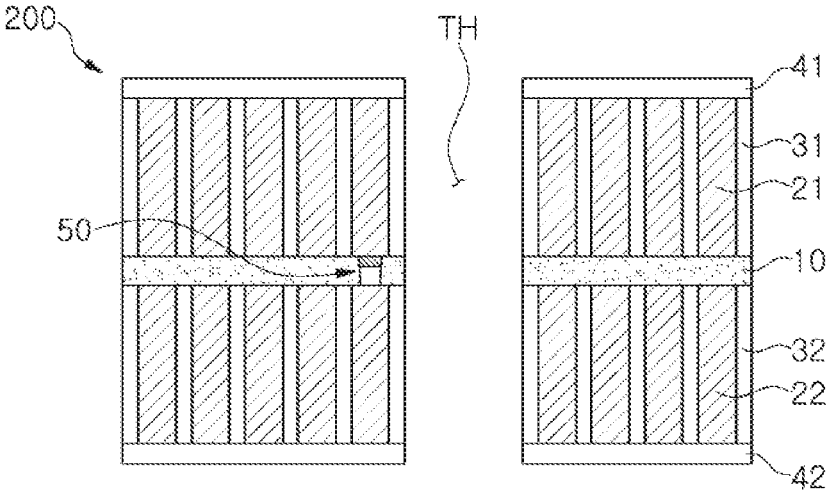

First, referring to FIG. 13, a through-hole TH may be processed.

The through-hole TH may be formed along dotted lines of FIG. 12 to penetrate through the coil portion 200. The through-hole TH may be formed in the coil portion 200 using a laser drill or a CNC drill.

Although not shown, an insulating wall forming insulating film on which the coil patterns 21 and 22 are not formed and the internal insulating layer 10 may be present on left and right sides of FIG. 12. This portion may be removed along with the through-hole TH in the present operation.

Figure 14:
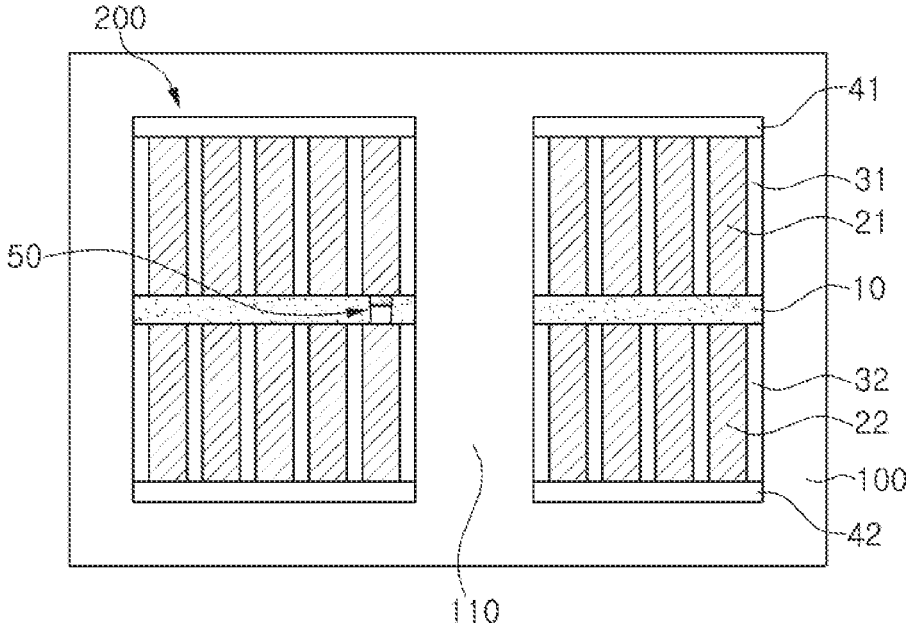

Then, referring to FIG. 14, a magnetic body 100 may be formed.

The magnetic body 100 may be formed by stacking magnetic sheets on opposite surfaces of the coil portion 200 but is not limited thereto.

The magnetic sheets disposed on the opposite surfaces of the coil portion 200 may be heated and pressurized and, in this case, at least a portion of the magnetic sheets may be moved to fill the through-hole TH of the coil portion 200 and to form the core 110.

As set forth above, according to the exemplary embodiment in the present disclosure, a coil component may reduce an overall thickness of a coil portion while a coil pattern is maintained in terms of a height thereof.

In addition, a coil component may be configured in such a manner that turns of a coil pattern are relatively uniformly formed.

While exemplary embodiments have been shown and described above, it will be apparent to those skilled in the art that modifications and variations could be made without departing from the scope of the present invention as defined by the appended claims.

What is claimed is:

1. A coil component comprising:

a magnetic body; and a coil portion embedded in the magnetic body, wherein the coil portion includes:

an internal insulating layer;

first and second coil patterns respectively disposed on opposite surfaces of the internal insulating layer;

a first insulating wall disposed between turns of the first coil pattern;

a second insulating wall disposed between turns of the second coil pattern;

a first external insulating layer covering the first insulating wall and the first coil pattern;

a second external insulating layer covering the second insulating wall and the second coil pattern; and a connection portion disposed in the internal insulating layer to connect the first coil pattern and the second coil pattern to each other, and wherein the first insulating wall includes:

a first protrusion protruding from an upper surface of the first coil pattern and extending in the first external insulating layer; and a second protrusion protruding from a lower surface of the first coil pattern, opposing the upper surface, and extending in the internal insulating layer, wherein a surface roughness of one surface of the first insulating wall facing the internal insulating layer is different from a surface roughness of another surface of the first insulating wall facing the first external insulating layer.

2. The coil component of claim 1, wherein the connection portion includes a first conductive layer and a second conductive layer having a melting point lower than a melting point of the first conductive layer.

3. The coil component of claim 1, wherein each of the first and second coil patterns is an electroplating layer.

4. The coil component of claim 1, wherein the internal insulating layer includes a photosensitive resin.

5. The coil component of claim 2, wherein the connection portion further includes a first intermetallic compound layer disposed between the first conductive layer and the second conductive layer.

6. The coil component of claim 5, wherein the second conductive layer is disposed between the first conductive layer and one of the first and second coil patterns, and the connection portion further includes a second intermetallic compound layer between the one of the first and second coil patterns and the second conductive layer.

7. The coil component of claim 1, wherein the magnetic body includes a core penetrating through the coil portion.

8. The coil component of claim 2, wherein the first conductive layer includes copper (Cu).

9. The coil component of claim 8, wherein the second conductive layer includes tin (Sn).

10. The coil component of claim 2, wherein the second conductive layer includes tin (Sn).

11. The coil component of claim 2, wherein a width of the second conductive layer is greater than a width of the first conductive layer.

12. The coil component of claim 1, wherein a surface of the first coil pattern facing the first external insulating layer is flat, and the flat surface of the first coil pattern, facing the first external insulating layer, extends from side surfaces of the first coil pattern.

13. The coil component of claim 1, wherein no seed layer is disposed between the first coil pattern and the internal insulating layer.

14. The coil component of claim 1, wherein no seed layer is disposed between the second coil pattern and the internal insulating layer.

15. The coil component of claim 1, wherein no seed layer is disposed between the first coil pattern and the internal insulating layer, and between the second coil pattern and the internal insulating layer.

16. The coil component of claim 1, wherein the second insulating wall includes a third protrusion protruding from a lower surface of the second coil pattern and extending in the second external insulating layer.

17. The coil component of claim 1, wherein the second insulating wall includes a fourth protrusion protruding from an upper surface of the second coil pattern and extending in the internal insulating layer.

18. The coil component of claim 1, wherein the second insulating wall includes:

a third protrusion protruding from a lower surface of the second coil pattern and extending in the second external insulating layer; and a fourth protrusion protruding from an upper surface of the second coil pattern and extending in the internal insulating layer.

19. The coil component of claim 1, wherein the first and second coil patterns are respectively disposed directly on the opposite surfaces of the internal insulating layer.

* * * * *